US005437262A

United States Patent [19]

George, II et al.

[11] Patent Number: 5,437,262

[45] Date of Patent: Aug. 1, 1995

[54] BURNER APPARATUS

[75] Inventors: Paul E. George, II, Powell; D. Karl Landstrom; Jembu K. Raghavan, both of Columbus, all of Ohio

[73] Assignee: Gas Research Institute, Chicago, Ill.

[21] Appl. No.: 198,120

[22] Filed: Feb. 17, 1994

[51] Int. Cl.[6] ..... F24C 3/00

[52] U.S. Cl. ..... 126/39 H; 126/39 R; 431/173; 431/185

[58] Field of Search ..... 126/39 R, 39 H, 39 J, 126/39 K; 431/185, 348, 173

[56] References Cited

U.S. PATENT DOCUMENTS 1,777,411 10/1930 Mayr ..... 431/173
3,782,883 1/1974 Nesbitt et al. ..... 431/348
4,054,409 10/1977 Ando et al. ..... 431/173

FOREIGN PATENT DOCUMENTS 265041 2/1927 United Kingdom ..... 431/348

*Primary Examiner*—Carroll B. Dority
*Attorney, Agent, or Firm*—Dick and Harris

[57] ABSTRACT

A burner apparatus for combustion of gaseous fuel and air, for use in range-top type environments, is provided. The burner apparatus includes a burner housing, an inlet, a combustion chamber, and a heat absorbing and radiating quarl surrounding the outlet to the combustion chamber. The burner apparatus is advantageously configured so as to provide for substantially uniform heating of an object supported above the combustion chamber, through a combination of convective and radiative heat transfer.

5 Claims, 1 Drawing Sheet

BURNER APPARATUS

BACKGROUND OF THE INVENTION

1. Field of the Invention

This invention relates generally to an apparatus and processes for the combustion of gaseous fuel and air mixtures, and more particularly, to a burner apparatus such as are used in home and commercial range-top stove applications.

2. Background Art

The search for ever more efficient, compact, and cost-effective burners is a longstanding one. For example, it would be desirable to produce a burner apparatus: with an improved thermal efficiency over a broad range of firing rates (that is, the combustion rate of the fuel/air mixture as represented in terms of BTU/hr); which is capable of providing a stable flame over a broad range of firing rates; which is capable of delivering heat to the object to be heated in a uniform manner, so as to avoid "hot spots"; and, having a simplified, less-expensive, and more durable construction.

Indeed, one of the techniques which has been attempted, for providing more complete (and thus more efficient) combustion, and for providing for efficient heating, is to cause the fuel/air mixture to undergo a swirling motion either before, during or after ignition. One such burner apparatus is disclosed in Schuetz, U.S. Pat. No. 4,419,074. Although a burner configured for stove-top use, the Schuetz burner employs a plurality of fuel nozzles which are angled, so as to introduce the fuel into the combustion chamber with a swirling motion, whereby the air is introduced into the combustion chamber via the suction created by the fuel stream and the ongoing combustion flow, once combustion has begun. The combustion products are then passed through conical and cup diffusers, for mixing of the combustion products with excess air, in an attempt to achieve complete combustion of the fuel.

Another burner apparatus which employs swirling appears to be disclosed in Alger, U.S. Pat. No. 3,196,927. In Alger, the fuel/air mixture is directed to a series of ports arranged in a circle, with angled tabs provided to produce a swirling motion to the gases, which are ignited to produce a swirling flame. The flame is then deflected around a circular disk to produce an annular cylindrical column of flame.

Elperin et al., U.S. Pat. No. 4,583,941 discloses a gas burner for producing a rotating flame, for use in stove-top applications. The Elperin burner includes a housing, the interior of which includes a plurality of passageways, which are both angled inward, so as to inwardly but not radially extend toward the center of the housing, and which are inclined upwardly from the outer portion of the housing toward the inner portion, so as to produce a series of rotating, spiraling flames underneath the object to be heated. A plurality of vertical support rods separate the top of the burner from the bottom of the object.

SUMMARY OF THE INVENTION

The present invention comprises a burner apparatus for the combustion of premixed gaseous fuel and air, and for heating an object positioned above the burner apparatus, by a combination of radiant heating and convective heating from the combustion.

The burner apparatus comprises a burner housing and an inlet, in the burner housing, for receiving the premixed gaseous fuel and air from a source of the premixed gaseous fuel and air. Means are provided for defining a combustion chamber within the burner housing, and for communicating the inlet and the combustion chamber with each other.

The preferred embodiment of the invention also includes means for producing a swirling motion of the premixed gaseous fuel and air, as the pre-mixed gaseous fuel and air enters the combustion chamber, the means for producing a swirling motion being operably associated with the means for communicating the inlet and the combustion chamber with each other. Means for defining an outlet throat for enabling escape of gases and heat, resulting from the combustion, from the combustion chamber, are operably disposed adjacent to the combustion chamber. The means for defining an outlet throat further being operably configured to substantially direct the gases and heat toward an object positioned above the burner apparatus. In addition, means for absorbing and re-radiating a portion of the heat produced by the combustion, are operably disposed adjacent to and in communication with the means for defining an outlet throat. The means for defining an outlet throat and the means for absorbing and re-radiating heat cooperating to substantially uniformly apply and direct heat produced by the combustion, to the object positioned above the burner apparatus through a combination of convective and radiative heat transfer.

In the preferred embodiment of the invention, the means for defining a combustion chamber within the burner housing comprises a burner block member operably disposed within the burner housing. The burner block member having an upper side, a lower side and a periphery and a substantially cylindrical recess in the upper side thereof. The substantially cylindrical recess having an interior peripheral surface, an upper opening, and a bottom surface thereof substantially enclosing the combustion chamber.

In the preferred embodiment of the invention, the means for communicating the inlet and the combustion chamber with each other is an annular passage in the burner housing, substantially surrounding the burner block member, and connecting the inlet to the combustion chamber.

It is further preferred that the means for producing a swirling motion of the premixed gaseous fuel and air, in a preferred embodiment of the invention, is a plurality of passageways extending through the burner block member. Each of the passageways begin at a position on the interior peripheral surface of the cylindrical recess, and emanate outwardly substantially tangentially therefrom to open into the annular passage in the burner housing.

Also in the preferred embodiment of the invention, the means for defining an outlet throat is an annular member operably disposed adjacent and substantially around the upper opening of the combustion chamber. The annular member further has an inner diameter less than an inner diameter of the upper opening of the combustion chamber.

The means for absorbing and re-radiating a portion of the heat produced by the combustion is, in the preferred embodiment of the invention, a collar member operably disposed substantially around the upper opening of the combustion chamber. The collar member includes a heat absorbing and radiating portion fabricated from a material capable of absorbing, distributing and radiating heat. The collar member further is operably configured so as to radiate the absorbed heat toward the object positioned above the burner apparatus.

In another preferred embodiment of the invention, the burner apparatus further comprises means for enabling the drainage of fluid which may inadvertently enter into the combustion chamber. It is also contemplated that a catch be positioned below a portion of the drainage means for catching the fluid as it is draining.

The invention also comprises a process for combustion of gaseous fuel and air, for the heating of an object via radiant and convective heat. The process comprises the steps of: a) providing a supply of premixed gaseous fuel and air; b) directing the premixed gaseous fuel and air to a combustion chamber, above which combustion chamber the object has been positioned; c) imparting a swirling motion to the premixed gaseous fuel and air as the premixed gaseous fuel and air enters the combustion chamber; d) igniting the premixed gaseous fuel and air; e) directing gases and a portion of the heat, resulting from combustion of the ignited swirling premixed gaseous fuel and air, directly toward the object, so as to heat the object via convective heat transfer; and f) absorbing a portion of the heat, resulting from combustion of the ignited premixed gaseous fuel and air, and re-radiating the heat toward the object, such that the object is substantially uniformly heated by a combination of convective and radiative heat transfer.

The process for the combustion of premixed gaseous fuel and air, in a preferred embodiment of the invention, further comprises the step of providing a source of secondary air to facilitate the combustion of the swirling premixed gaseous fuel and air.

DETAILED DESCRIPTION OF THE DRAWINGS

Figure 1:
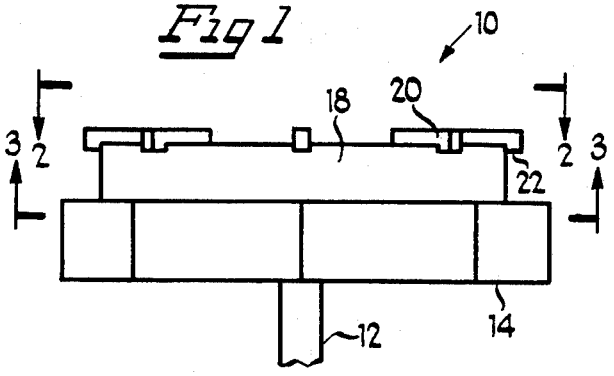
FIG. 1 is a side elevation of the burner apparatus according to the preferred embodiment of the invention.
Figure 2:
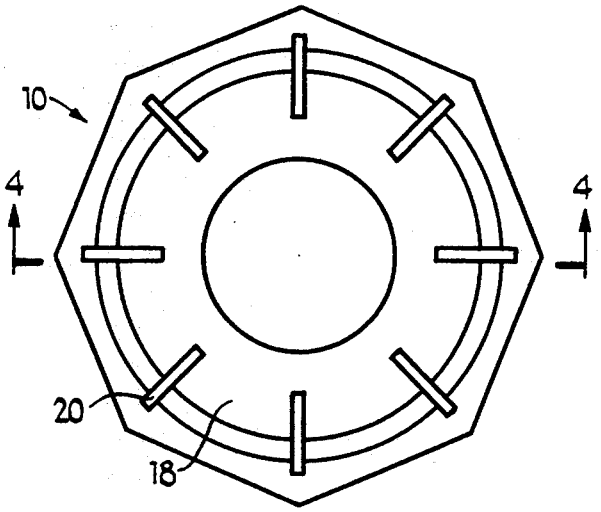
FIG. 2 is a top plan view of the burner apparatus according to FIG. 1.
Figure 3:
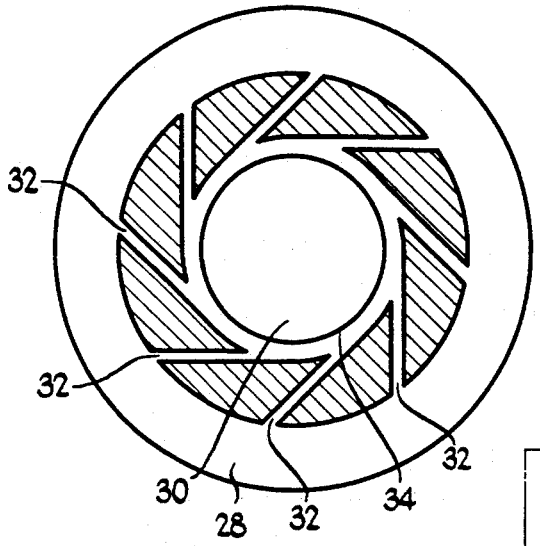
FIG. 3 is a top plan view, in section, of the burner apparatus according to FIG. 1.

While this invention is susceptible of embodiment in many different forms, there is shown in the drawings and will be herein described in detail, two specific embodiments, with the understanding that the present disclosure is to be considered as an exemplification of the principles of the invention and is not intended to limit the invention to the embodiments illustrated.

Figure 4:
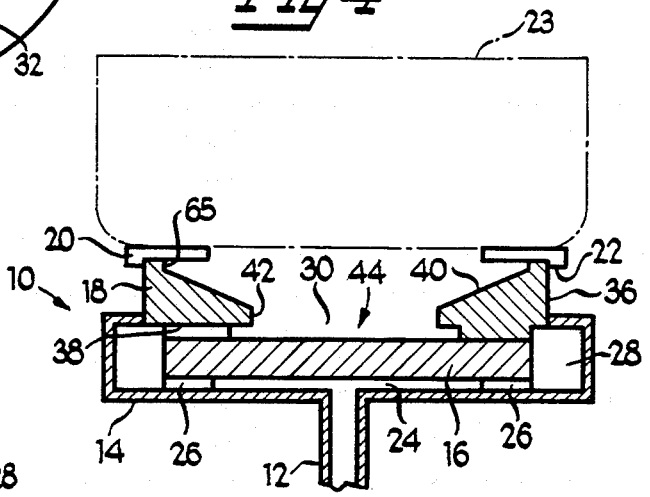
FIG. 4 is a side elevation, in section, of the burner apparatus according to FIG. 1.

Burner apparatus 10, shown in FIGS. 1–4, is of the type configured for use in range-top environments, such as in a home kitchen stove or commercial restaurant range, and includes inlet 12, housing 14, burner block 16, quarl 18, and grate 20. In the preferred embodiment of the invention, burner apparatus 10 will be installed in a range-top such that the lower surfaces 22 of grate 20 will rest upon the upper surface of the range-top (not shown). In use, burner apparatus 10 will be used to heat an object resting on grate 20, such as vessel 23 as shown in FIG. 4.

Burner block 16 has formed in its lower surface a short cylindrical disk-shaped opening 24, as seen in side elevational sectional view in FIG. 4, which opening 24 is in fluid communication with inlet 12. Burner block 16 is positioned within housing 14, and so configured as to provide for a plurality of radial passageways 26, emanating from opening 24, outwardly to annular passageway 28. A further disk-shaped opening in the upper surface of burner block 16 defines combustion chamber 30. Combustion chamber ports 32 extend inwardly from annular passageway 28 to combustion chamber 30, at angles substantially tangential to the periphery 34 of combustion chamber 30.

Quarl 18 is configured in the shape of an annulus, having a substantially vertical outer periphery 36, a lower surface 38 which rests flatly atop burner block 16, and a funnel-like upper surface 40. The included angle which the upper surface 40 of quarl 18 makes with the horizontal, in the preferred embodiment of the invention, is approximately 30°, although other angles may be used. The inner periphery 42 of quarl 18 defines a throat 44 having a diameter which is less than the diameter of combustion chamber 30. For a burner apparatus 10 having an overall diameter of, for example, 7.8 in., then a throat 44 having a diameter of 3.5 in., a combustion chamber having a diameter of 5.0 in., a grate to throat height of 1.5 in. and, a top lip 65 of quarl 18 to bottom of pot 23 distance of approximate 0.50 in. are preferred—although other proportions are also contemplated and/or appropriate for other applications. It is also preferred that the number of combustion chamber ports 32 provided, be 8, with each port 32 having a preferred port width of 0.0625 in.

In a preferred embodiment of the invention, inlet 12, and housing 14 is fabricated from carbon steel—although any other suitable material, such as cast iron, various alloys, or even various plastic materials may be employed, so long as the particular material is capable of withstanding the heating and temperatures, commensurate with the operation and other materials utilized in the fabrication of the burner apparatus, for extended periods of time and for numerous thermal cycles, without substantial deformation or other degradation of the material or shape.

Burner block 16 and quarl 18, may be fabricated from a high temperature resistant fibrous ceramic board. For example, an alumina fiberboard known as Ceraboard has been employed in apparatus 10, which is known to withstand temperatures of up to 2300° F. for extended periods of time. This material has also been shown to be suitable due to its machinability characteristics as well. However, it is also contemplated that, for example, in a production burner constructed for extended use in a home or business, a tougher, more durable, ceramic material may be desired. A number of such materials are conventionally known, and any such materials could be used, provided that the necessary characteristics are met: namely, resistance to high temperatures for sustained periods of time, physical durability and resistance to thermal cycling without substantial deformation or cracking, and the capacity to absorb heat and re-radiate the absorbed heat substantially in a desired direction (emissivity).

Although burner block 16 and quarl 18 are depicted as being constructed throughout their thicknesses of homogeneous material, as it is the outer surfaces which will be primarily in contact with the heat of combustion, and which heat will be predominantly re-radiated toward the object to be heated, in order to save on manufacturing costs, burner block 16 and quarl 18 alternatively could be fabricated as refractory ceramic shells around cores of less expensive, less-temperature resistant material.

Grate 20 may be fabricated from cast iron or any other suitable metal or other material used for stove-top gratings. In the preferred embodiment, greater thermal efficiency is obtained, when the object to be heated is supported low, close to the upper rim of quarl 18. Accordingly, grate 20 is preferably advantageously configured to separate vessel 23 from quarl 18 by approximately 0.50 in.

In operation, a suitable mixture of gaseous fuel and air are supplied through inlet 12, after being metered through an appropriate venturi and valve connection from the supply, which may be town gas, LPG, or the like, in the usual manner. The mixture enters opening 24, passes through passageways 26, through annular passageway 28, and through combustion chamber ports 32 into combustion chamber 30. As the gaseous mixture exits inlet passageways 32, a swirling motion is imparted to the gases, particularly at higher volumetric flow rates.

Figure 5:
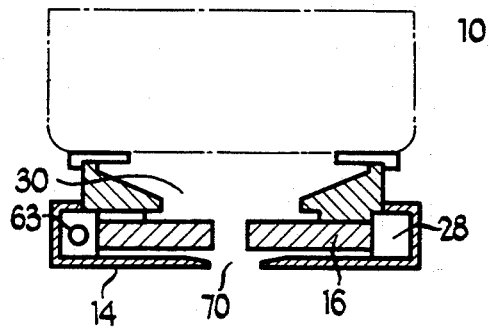
FIG. 5 is a side elevation, in section, of an alternative preferred embodiment of the burner apparatus according to FIG. 1.

Although it is shown that gaseous fuel and air are entering through inlet 12 at the bottom of housing 14, it is also contemplated that such a mixture enter through other alternative channels, such as through side inlet 63 (FIG. 5), of housing 14, and then directly into passageway/plenum 28 (FIG. 5). Accordingly, when such an alternative is used, the bottom of housing 14 can facilitate drainage of fluid, such as soup, which may inadvertently spill into combustion chamber 30—without such fluid interfering with the gaseous fuel and air mixture. Indeed, when such an embodiment is employed, an aperture, such as aperture 70 (FIG. 5) can be fabricated into a portion of burner block 16 for enabling such drainage toward and into a catch tray (not shown).

The gaseous mixture is ignited by any suitable known ignition apparatus, which should be located within combustion chamber 30, but should not project into combustion chamber 30 in such a manner as to disrupt the swirling flow of the gaseous mixture. A conventional spark-type ignition device would be adequate. The swirling flow continues through the combustion process, and helps promote more complete combustion of the fuel.

The combustion chamber 30 and quarl 18 are so configured that during the combustion process, the flame remains in the combustion chamber 30, with little, if any direct contact of the flame with quarl 18. A portion of the heat from the combustion proceeds directly upward as convective heat to impinge upon the bottom of vessel 23, for example. Due the continued swirling motion of the combustion gases, the heat carried along with the gases, strikes the vessel 23 with a swirling motion. During boiling tests to observe the heating of vessel 23, no apparent "hot spots" were created and a substantially uniform distribution of bubbles was generated along the interior of the bottom of the vessel.

Another portion of the heat from the combustion is radiated from the flame in the combustion chamber and absorbed along the inner periphery 42 of quarl 18. This heat is transferred upward along the slope of quarl 18 and re-radiated upward from the upper surface 40.

The burner apparatus of the present invention accomplishes uniform heating, with improved thermal efficiencies, over a broad range of firing rates. A burner apparatus 10 having the physical characteristics described previously (size characteristics appropriate for a commercial application) is capable of providing a steady flame when operating at rates of approx. 1400 BTU/hr to nearly 28,000 BTU/hr, thus having a turndown ratio of nearly 20:1. Even at the lowest firing rates, no flame-out or flashback was observed during testing. In smaller burner constructions, stable flame at firing rates of approximately 500 BTU/hr is maintainable, presenting a degree of control not previously available in gas range-top burners.

As mentioned previously, improved thermal efficiency is an additional by-product of the present invention. In the construction previously described, at high firing rates (>10,000 BTU/hr) very rapid swirling of the combustion gases promotes more complete combustion, and efficiencies of approximately 70% can be achieved. Even at low firing rates, efficiencies of 52%–55% are obtainable. These efficiencies are substantially greater than the efficiency of conventional home range-top burners, and are comparable to presently known high-efficiency (and higher cost) commercial-sized burners. Additionally, the burner apparatus of the present invention will suffer only slight efficiency losses (approx. 10%) when operating in excess air conditions.

The metal parts of burner apparatus 10, i.e., housing 14, are not required to manage temperatures as high as those encountered by quarl 18 and burner block 16, due to the improved efficiency of the swirling convective heating, which tends to carry the combustion heat quickly upwardly toward the object to be heated, and of the quarl to direct the absorbed heat in the desired direction, while not allowing significant heating of the housing 14, or other lower portions of the burner apparatus 10. Accordingly, a further advantage of the present invention, is less need for thermal insulation around the burner apparatus, to contain heat and protect other portions of the range-top in which the burner apparatus 10 is mounted.

Further observed advantages of the present invention include lower emissions of oxides of nitrogen (NOx), and more rapid ignition of the fuel/air mixture toward total flame involvement, and general improved flame stability, both with the pan or other object on or off the grate.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A burner apparatus for the combustion of premixed gaseous fuel and air, and for heating an object positioned above said burner apparatus, by a combination of radiant heating and convective heating from said combustion, said burner apparatus comprising:

a burner housing;

an inlet, in said burner housing, for receiving said premixed gaseous fuel and air from a source of said premixed gaseous fuel and air;

means for defining a combustion chamber within said burner housing, said combustion chamber having a first diameter;

means for communicating said inlet and said combustion chamber with each other including means for producing a swirling motion of said premixed gaseous fuel and air, as said premixed gaseous fuel and air enters said combustion chamber;

a quarl member defining an outlet throat for enabling escape of gases and heat, resulting from said combustion, from said combustion chamber, said outlet throat having second diameter which is less than said first diameter of said combustion chamber for facilitating retention of flame within said combustion chamber; and said quarl member including means for absorbing and re-radiating a portion of said heat produced by said combustion, operably disposed adjacent to and substantially downstream from said outlet throat, said quarl member having an outside diameter which is substantially greater than said first diameter of said combustion chamber, said quarl member further having an annular configuration with an upper surface which inclines upwardly from a radially inward position to a radially outward position, means for supporting an object to be heated on or above said quarl member;

said quarl member absorbing and re-radiating heat to substantially uniformly apply and direct heat produced by said combustion, to said object positioned above said burner apparatus through a combination of convective and radiative heat transfer.

2. The burner apparatus according to claim 1, wherein said means for defining a combustion chamber within said burner housing comprises:

a burner block member operably disposed within said burner housing, said burner block member having an upper side, a lower side and a periphery, said burner block member having a substantially cylindrical recess in said upper side thereof, said substantially cylindrical recess having an interior peripheral surface, an upper opening, and a bottom surface thereof substantially enclosing said combustion chamber.

3. The burner apparatus according to claim 2, wherein said means for communicating said inlet and said combustion chamber with each other comprises:

an annular passage in said burner housing, substantially surrounding said burner block member.

4. The burner apparatus according to claim 3, wherein said means for producing a swirling motion of said premixed gaseous fuel and air comprises:

a plurality of passageways extending through said burner block member, each of said passageways beginning at a position on said interior peripheral surface of said cylindrical recess, and emanating outward substantially tangentially therefrom to open into said annular passage in said burner housing.

5. The invention according to claim 1, wherein said burner apparatus further comprises means for enabling drainage of fluid which may inadvertently enter into said combustion chamber.

* * * * *